US005586053A

United States Patent [19]

Park

[11] Patent Number: 5,586,053

[45] Date of Patent: Dec. 17, 1996

[54] METHOD TO DETERMINE THE BLADE SHAPE OF A SIROCCO FAN

[75] Inventor: In C. Park, Seoul, Rep. of Korea

[73] Assignee: Goldstar Co., Ltd., Seoul, Rep. of Korea

[21] Appl. No.: 105,997

[22] Filed: Aug. 13, 1993

[30] Foreign Application Priority Data

Aug. 14, 1992 [KR] Rep. of Korea ..... 1992-14700

[51] Int. Cl.[6] ..... F04D 29/30

[52] U.S. Cl. ..... 364/512; 416/178; 416/DIG. 2; 416/DIG. 5

[58] Field of Search ..... 416/DIG. 2, DIG. 5; 364/512, 474.24, 505, 578; 73/104

[56] References Cited

U.S. PATENT DOCUMENTS

| | | | |
|---|---|---|---|
| 4,102,596 | 7/1978 | Itayama | 415/101 |
| 4,165,950 | 8/1979 | Masai et al. | 416/178 |
| 4,569,631 | 2/1986 | Gray, III | 416/DIG. 2 |
| 4,569,632 | 2/1986 | Gray, III | 416/DIG. 2 |
| 4,742,473 | 5/1988 | Shugar et al. | 364/578 |
| 4,773,825 | 9/1988 | Rodde et al. | 416/DIG. 2 |
| 4,930,984 | 6/1990 | Kesel et al. | 416/203 |
| 4,971,520 | 11/1990 | Van Houten | 416/DIG. 5 |
| 4,981,414 | 1/1991 | Sheets | 415/149.1 |
| 5,035,377 | 7/1991 | Buchelt | 416/DIG. 2 |
| 5,064,346 | 11/1991 | Atarashi et al. | 416/178 |
| 5,148,379 | 9/1992 | Konno et al. | 364/578 |
| 5,197,854 | 3/1993 | Jordan | 416/DIG. 5 |
| 5,368,440 | 11/1994 | Japikse et al. | 415/208.3 |
| 5,427,503 | 6/1995 | Haraga et al. | 416/178 |

OTHER PUBLICATIONS

Abbott et al., "Theory of Wing Sections", Dover Publications Inc., 1959.

*Primary Examiner*—James P. Trammell
*Assistant Examiner*—Eric W. Stamber
*Attorney, Agent, or Firm*—Spencer & Frank

[57] ABSTRACT

This invention relates to a method to dertermine the shape of a fan blade of a sirocco fan which can improve fan efficiency and reduce the noise from flow, comprising the steps of determinating a camber line and, upper surface and lower surface of the blade by equations which define mean line and thickness distribution of NACA wing sections, respectively and determinating maximum ordinate of the camber line by following equation;

$$Ta=2m/p$$

where, Ta is leading edge angle, m is maximum ordinate of mean line and, p is chordwise position of maximum ordinate.

4 Claims, 3 Drawing Sheets

METHOD TO DETERMINE THE BLADE SHAPE OF A SIROCCO FAN

FIELD OF THE INVENTION

This invention relates to a sirocco fan used in various air conditioners, more particularly to a method to determine (or to fix the position, form or configuration of) the shape of a fan blade of a sirocco fan which can improve fan efficiency and reduce the noise from flow.

BACKGROUND OF THE INVENTION

Generally, a sirocco fan includes, as shown in FIG. 1, a fan 1 having blades 2 around the rotational axis of the fan, the blades 2 being formed to curve forward relative to the direction of rotation R.

Air flows through the blade 2 from leading edge A to trailing edge B along the contour of the blade.

In this time, the air flow within the chord C slopes down deeply according to the contour of the chord and the air flow outside of the chord D can not be continuous inspire of the inertia of air flow, but separate from the blade 2.

This flow separation results in a decrease in speed and a reduction in efficiency due to the formation of drag.

The existence of wake zone downstream of the cutting 2*a* formed at the outer end of the blade 2 causes noise by the small vortex formed therein.

SUMMARY OF THE INVENTION

The object of this invention is to provide a method to determine the shape of a fan blade of a sirocco fan which can prevent loss of dynamic energy and improve fan efficiency by the reduction of the formation of wake formed by the flow separation.

Another object of the invention is to provide a method to determine the shape of a fan blade of a sirocco fan which can reduce the noise from air These and other objects can be achieved by providing camber line and, tapper surface and lower surface of a fan blade according to the NACA equation for the definition of mean line and thickness distribution of a wing section respectively, and by providing the maximum ordinate(m) of the camber line according to the equation of $Ta=2m/p$($Ta$: leading edge angle, p: chordwise position of maximum ordinate)

In the blade of a sirocco fan of this invention, a camber line is defined by equations 1) and 2) below, thickness distribution on a camber line perpendicular to a tangential line at any position x on the camber line is defined by equation 3) and the maximum ordinate of a camber line is defined by equation 4) below;

$$y_c=(m/p^2)\cdot(2px-x^2);\ \text{wherein } 0\leqq x\leqq p \qquad 1)$$

$$y_c=[m/(1-p)^2]\cdot[(1-2p)+(2px-x^2)];\ \text{wherein } p<x\leqq 1 \qquad 2)$$

where, $y_c$ is y coordinate of a camber line, m is maximum ordinate of a camber line, p is chordwise position of maximum ordinate, (when the length of chord is taken as unity)

x is chordwise abscissa.

$$\pm y_t = t/0.20\cdot(0.29690\sqrt{x} - \qquad 3)$$

-continued $$0.12600x - 0.35160x^2 - 0.28430x^3 - 0.10150x^4)$$

where, $y_t$ is ordinate of thickness to a tangential line at position x, t is maximum thickness.

$$Ta=2m/p \qquad 4)$$

where, Ta is leading edge angle.

DETAILED DESCRIPTION OF THE INVENTION

Airplane wing sections used in common today are mainly NACA(National Advisory Committee Aeronautics) wing sections, which can be obtained by the combination of camber line(mean line) and thickness distribution.

The fan blade of the sirocco fan of this invention can be obtained through the application of camber line and thickness distribution of the NACA wing sections, particularly the four-digit wing sections, where leading edge and trailing edge are the forward and aft end of the camber line, respectively, and chordline is the straight line connecting the leading edge and trailing edge.

Figure 1:
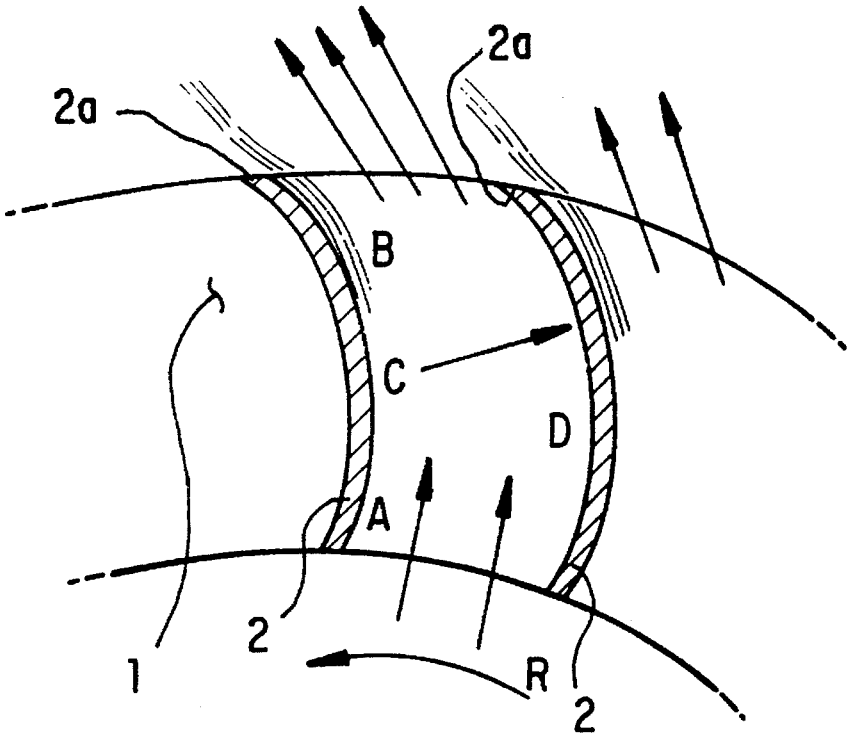
FIG.1 PRIOR ART
FIG. 1, shows construction of general sirocco fan.
Figure 2:
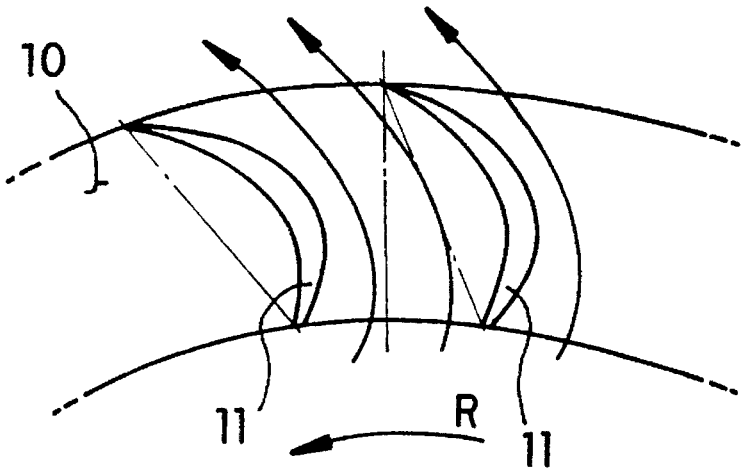
FIG. 2 shows construction of a sirocco fan according to this invention.

Shown in FIG. 2 is the construction of a sirocco fan according to this invention, wherein blades 11 are arranged around the rotational axis of a sirocco fan 10.

Figure 3:
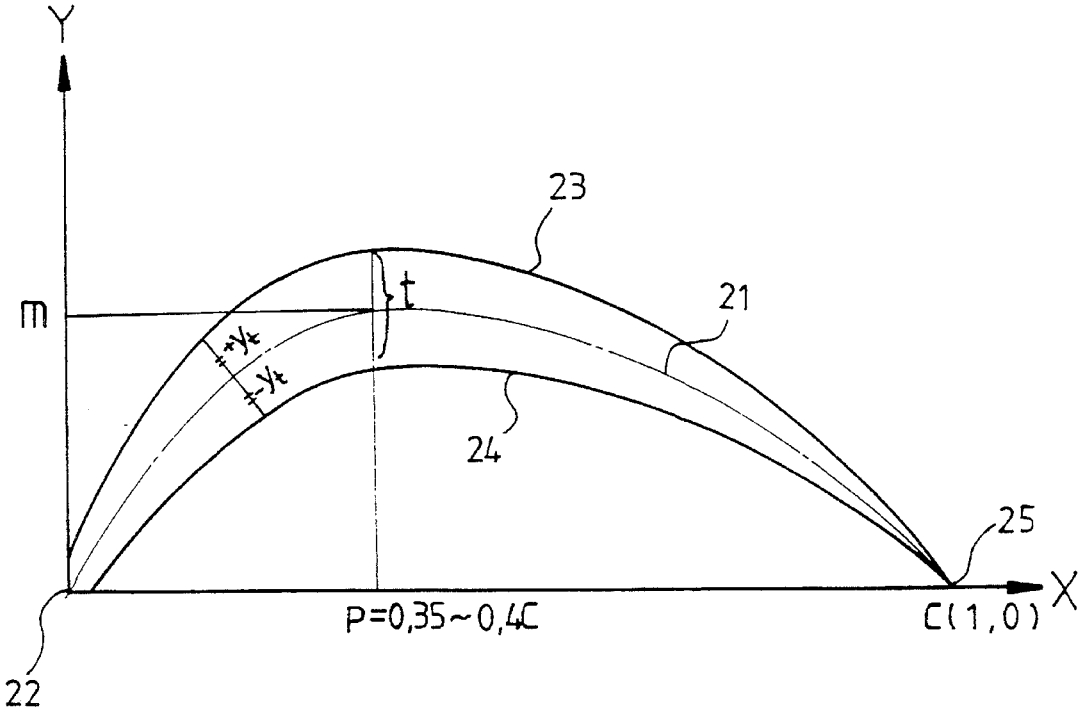
FIG. 3 shows construction of the wing section of NACA four-digit series family applied to the fan blade of a sirocco fan according to this invention.

Shown in FIG. 3 is detail of the shape of a fan blade of a sirocco fan according to this invention obtained through the application of NACA four-digit wing sections, wherein the camber line of the NACA four-digit wing sections applicable to the blade camber line according to this invention can be obtained by following equations 1) and 2)

$$y_c=(m/p^2)\cdot(2px-x^2); \qquad 1)$$

wherein $0<x<p$ $$y_c=[m/(1-p)^2]\cdot[(1-2p)+(2px-x^2)]; \qquad 2)$$

wherein $p<x\leqq 1$ where, $y_c$ is y coordinate of camber line 21, m is maximum ordinate of chamber line expressed in the fraction of chord, p is chordwise position of maximum ordinate, (when the length of chord is taken as unity)

x is chordwise abscissa.

The thickness distribution on a camber line perpendicular to a tangential line at any position x on the camber line 21 for NACA four-digit wing sections is provided by following equation;

$$\pm y_t = t/0.20\cdot(0.29690\sqrt{x}-0.12600x-0.35160x^2+0.28430x^3-0.10150X^4)$$

where $y_t$ is ordinate of thickness perpendicular to a tangential line at position x and, t is maximum thickness.

Figure 4:
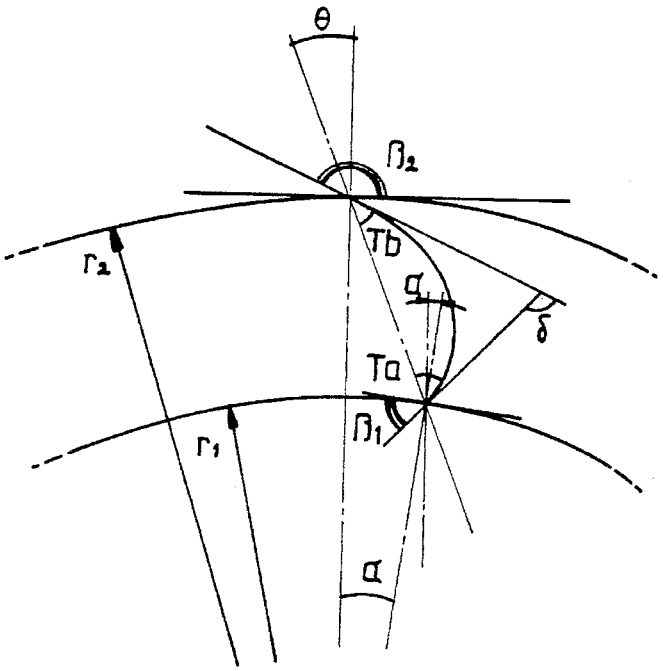
FIG. 4 is a schematic diagram showing the geometry of a fan blade of a sirocco fan according to this invention.

In the meantime, as shown in FIG. 4, the geometrical parameters for the fan blade of a sirocco fan according to this invention obtained through the application of camber line and thickness distribution of NACA four-digit wing sections have following relations;

when, $$T_b=\beta_2-90°-\alpha \quad 4)$$

$$Ta+Tb=\delta \quad 5)$$

by combining above equations 4) 5)

$$Ta(180°/\pi)=\delta+90°+\theta-\beta_2 \quad 6)$$

As shown in FIG. 4, r1 is inner radius of the sirocco fan, r2 is outer radius of the sirocco fan, $\beta_1$ it is blade inlet angle, $\beta_2$ is blade outlet angle, $\delta$ is deflection angle, Ta is leading edge angle, Tb is trailing edge angle, $\theta$ is blade setting angle and $\alpha$ is dividing angle.

According to experimental result of the sirocco fan, in above equation 6), the optimum value of the geometrical parameters have following ranges;

$\delta_2$=165°~170°

$\delta$=90°~93°

$\theta$=20°~25°

Accordingly, the optimum value of said Ta is determined to be 43°~30° (0.75~0.52 radian) by equation 6).

And as the slope of camber line at forward end 22 is the same with leading edge angle Ta, following equation 7) can be established;

$$(dy_c/dx)_{x=0}=2m/p=Ta \quad 7)$$

Figure 5:
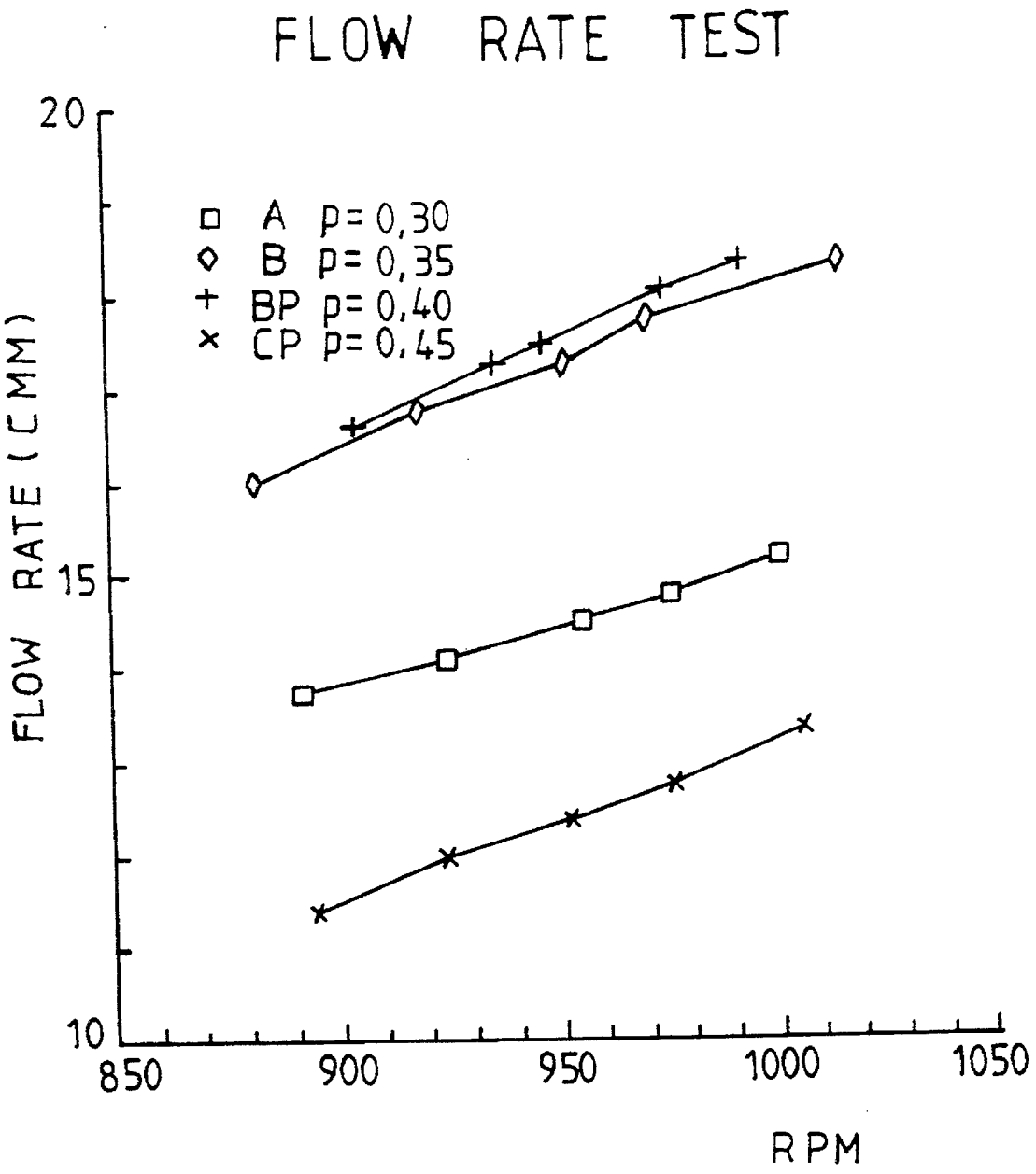
FIG. 5 is a graph showing the result of flow rate test of a sirocco fan according to this invention.

Accordingly, in the determination of m and p values which are important parameter in calculation of camber line 21, if p value, considering the normal value being within the range of 0.25–0.45, is determined to be 0.35–0.4 according to the test results shown in FIG. 5, and if Ta value is determined to be 0.75–0.52 rad, m value can be easily obtained by equation 7).

Thus, camber line 21 can be determined by equations 1) and 2).

Once camber line 21 is determined by equations 1) and 2), upper surface 23 and lower surface 24 of the blade is determined by the thickness distribution equation 3).

In the sirocco fan blade according to this invention described above, the camber line and thickness distribution of NACA four-digit wing sections used mainly in low speed airplane wing section design being adapted, air flows through the blade 11 along the geometry of the wing section without making any boundary layer separation within and outside of the chord not causing any turbulent flow.

Particularly, the reduction of noise from air flow is possible, because the sharp aft end 25 of the blade 11 do not provide the chance of wake to occur.

Shown in FIG. 5 is the flow rate test result of a sirocco fan blade according to this invention, applied to a room air conditioner showing the flow rate being specially high at P=0.35 and P=0.4.

The noise characteristics of a sirocco fan blade is reduced about 1.6dB particularly in high frequency band relative to a coventional fan.

Though this invention has been described in connection with the NACA four-digit wing section for the design of a blade, it is not limited to above NACA four-digit wing section in the design of the blade, but NACA five-digit family and NACA six-digit wing section family can also be adapted.

In these cases too, in the design of a sirocco fan blade, upper surface and lower surface of a blade can be obtained by the equation of thickness distribution for each family after the determination of important parameters of m and p as geometrical parameters in a sirocco fan design.

As explained above, through the application of the mean line and the thickness distribution of NACA wing sections in designing the shape of the blade, the sirocco fan according to this invention is designed not to interfere air flowing along stream line to suppress the occurance of wake observed in turbulent flow and minimize flow energy loss thereby improve the fan efficiency of a sirocco fan.

And noise from air flow is reduced in high frequency band by eliminating wake zone.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A method of fixing the configuration of blades in a sirocco fan which includes a plurality of blades having a direction of rotation about a rotational axis, comprising the steps of:

radially spacing said blades from the rotational axis with each blade extending laterally parallel to the rotational axis and curved forward in the direction of rotation, forming each blade with a camber line and thickness distribution as defined by a National Advisory Committee Aeronautics wing section, said camber line having a leading edge and a trailing edge at opposite outer ends thereof, and having a maximum ordinate of camber line as defined by:

$$[Ta=2m/p]$$

$$m=(Ta\cdot p)/2$$

where Ta is leading edge angle, m is maximum ordinate of camber line, and p is chordwise position of maximum ordinate, the leading edge being formed at a radius r1 from the rotational axis and the trailing edge formed being at a radius r2 from the rotational axis, where r2>r1 and where the trailing edge is angularly in advance of the leading edge in the direction of rotation, whereby air enters the fan between the blades at the leading edges thereof and exits from the fan at the trailing edges thereof with a reduction in wake formed by flow separation.

2. The method of claim 1 wherein each blade is fixed in the form with said camber line having the following configuration:

$$y_c=(m/p^2)\cdot(2px-x^2),$$

wherein $0\leqq x\leqq p$;

$$y_c=(m/(1-p)^2)\cdot((1-2p)+(2px-x^2)),$$

wherein $p<x\leqq 1$;

where, $y_c$ is y coordinate of a camber line, m is maximum ordinate of a camber line, p is chordwise position of maximum ordinate, and (when the length of chord is taken as unity)

x is chordwise abscissa;

a thickness distribution on said camber line perpendicular to a tangential line at any position x on said camber line being fixed in the following configuration:

$$\pm y_t = t/0.20\cdot(0.29690\sqrt{x} - 0.12600x - 0.35160x^2 + 0.28430x^3 - 0.10150x^4)$$

where, $y_t$ is ordinate of the thickness perpendicular to a tangential line at position x, and t is maximum thickness.

3. The method of claim 2 wherein p equals 0.35 to 0.40, Ta equals 0.75 to 0.52 rad, and wherein Ta is:

$$Ta(180°/\pi) = \delta + 90° + \theta - \beta_2$$

where, $\delta$ is deflection angle, $\theta$ is blade setting angle, $\beta_2$ is blade outlet angle.

4. The method of claim 3 wherein $\delta$ equals 90° to 93°, $\theta$ equals 20° to 25° and $\beta_2$ equals 165° to 170°.

* * * * *